US006199705B1

(12) United States Patent
Portner

(10) Patent No.: US 6,199,705 B1
(45) Date of Patent: Mar. 13, 2001

(54) LIGHTING FIXTURE DISPLAY

(75) Inventor: Joel Portner, Cherry Hill, NJ (US)

(73) Assignee: Angelo Lighting, Inc., Philadelphia, PA (US)

( * ) Notice: Subject to any disclaimer, the term of this patent is extended or adjusted under 35 U.S.C. 154(b) by 0 days.

(21) Appl. No.: 09/293,759

(22) Filed: Apr. 16, 1999

Related U.S. Application Data

(60) Provisional application No. 60/082,968, filed on Apr. 24, 1998.

(51) Int. Cl.[7] ..... A47F 7/00

(52) U.S. Cl. ..... 211/26; 211/94.01; 362/219; 52/726.3; 312/223.6

(58) Field of Search ..... 211/26, 26.2, 87.01, 211/94.01, 189; 362/147, 249, 270, 370, 382, 219, 221, 430–431, 457; 52/40, 726.3, 736.1, 570, 579, 588.1; 312/223.5, 223.6

(56) References Cited

U.S. PATENT DOCUMENTS

| | | | | |
|---|---|---|---|---|
| 1,800,387 | | 4/1931 | Greist . | |
| 4,420,087 | | 12/1983 | Johns | 211/189 |
| 4,489,995 | * | 12/1984 | Barr | 312/223.3 |
| 4,497,411 | * | 2/1985 | DeBortoli | 211/26.2 |
| 4,591,058 | | 5/1986 | Amstutz et al. | 211/94.01 |
| 4,607,753 | | 8/1986 | Radek | 211/87.01 |
| 4,615,448 | | 10/1986 | Johnstonbaugh | 211/94.01 |
| 4,713,734 | * | 12/1987 | DeKay | 362/147 |
| 4,747,025 | | 5/1988 | Barton | 362/147 |
| 4,775,921 | | 10/1988 | Foley | 362/147 |
| 4,805,783 | | 2/1989 | Mayer | 211/94.01 |
| 4,835,915 | | 6/1989 | Nilssen | 52/28 |
| 4,944,416 | | 7/1990 | Petersen et al. | 211/87.01 |
| 5,022,720 | * | 6/1991 | Fevig et al. | 312/223.6 |
| 5,044,135 | * | 9/1991 | Kroon et al. | 312/239 |
| 5,101,989 | | 4/1992 | Jones | 211/94.01 |
| 5,138,803 | | 8/1992 | Grossen | 52/36 |
| 5,142,460 | | 8/1992 | McAtee | 362/249 |
| 5,142,832 | | 9/1992 | Branham, Sr. et al. | 52/36 |
| 5,186,337 | * | 2/1993 | Foster et al. | 211/26.2 |
| 5,241,796 | * | 9/1993 | Hellwig et al. | 52/36.4 |
| 5,348,485 | * | 9/1994 | Briechle et al. | 439/110 |
| 5,375,802 | | 12/1994 | Branham, II | 248/231.4 |
| 5,398,468 | | 3/1995 | Erickson | 52/282.3 |
| 5,425,648 | * | 6/1995 | Farham | 439/116 |
| 5,695,261 | * | 12/1997 | Slesinger et al. | 312/223.6 |
| 5,765,939 | * | 6/1998 | Tanner, Jr. | 362/219 |
| 5,775,521 | * | 7/1998 | Tisbo | 211/94.01 |
| 5,820,255 | * | 10/1998 | Carrington et al. | 362/431 |
| 5,941,026 | * | 8/1999 | Eisenreich et al. | 211/87.01 |

* cited by examiner

*Primary Examiner*—Daniel P. Stodola
*Assistant Examiner*—Jennifer E. Novosad
(74) *Attorney, Agent, or Firm*—Seidel Gonda Lavorgna & Monaco, PC

(57) ABSTRACT

A display for a plurality of electrical fixtures, such as lighting fixtures. The display includes a slat board type mounting panel having a plurality of elongated generally horizontal grooves in the front surface thereof. A plurality of mounting plates are provided having flanges that are adapted to be retained within the grooves of the slat board for removably supporting the mounting plates on the front surface of the panel. An electrical wire is secured to the plates. A male plug attached to one end of the wire. A retainer is provided on opposite sides of the mounting panel to support the panel. The retainer has a U shaped channel therein. A series of electrical receptacles are mounted within the channel. The plug may be inserted into the receptacles for providing electrical power to the mounting plates. The retainer includes an opening therein that mates with the grooves of the slat board. The electrical wire extends along the grooves to the side edges of the panel and then inserted into the receptacle within the retainer. The retainer serves to support the mounting panel as well as retain the electrical connections for the display.

15 Claims, 5 Drawing Sheets

LIGHTING FIXTURE DISPLAY

RELATED APPLICATION

The present invention is related to and claims the benefit of U.S. Provisional Application Ser. No. 60/082,968 filed Apr. 24, 1998.

FIELD OF THE INVENTION

The present invention relates to a display for lighting and other type fixtures that may be hung on a wall or on a ceiling. The display movably mounts the fixtures and provides an electrical connection for operating the fixture.

BACKGROUND OF THE INVENTION

The display of the present invention preferably includes a main display panel which is composed of "slat board". Slat board is a common display material that includes a series of lateral "T" shaped or similar shaped grooves or slots in a rigid board. Retail stores typically use slat board on walls and the like to display their products. Fixtures are placed within the grooves and are movable along the length of the board. Typical fixtures include hanger racks, shelving and the like. Because of the multiple, elongated grooves in the panels, slat board type displays inherently offer versatility to the arrangement of the goods being displayed.

Previously, slat board type constructions have been used to display lighting fixtures and the like. Branham, Sr. et al U.S. Pat. No. 5,142,832 shows a wall mounting system having a slat board type structure to which various fixtures may be mounted. A retainer having a threaded bolt is inserted into the groove of the slat board to support a fixture, such as a lighting fixture. A switch may be provided within the groove. The switch forms a part of the electrical connection which extends from the fixture, along the groove and projects from the side edge of the board.

Branham, II U.S. Pat. No. 5,375,802 shows a structure for fastening display mounts, including lighting fixtures, to a slat board. The particular groove within the slat board has curved surfaces. A mounting plate having a resilient support is incorporated into the display.

McAtee U.S. Pat. No. 5,142,460 shows a display having a series of lighting fixtures mounted to a support board and canopy. There are no mounting plates incorporated into the display. The electrical connections from the lighting fixtures are inserted through openings within the board (and canopy). The wires extend through a hollow structure to a receptacle bank which is located behind the display.

It is also known to use slat board type constructions in a manner similar to that shown in the McAtee patent identified above. A mounting plate is movably secured in the grooves of the slat board. A wire is attached to the plate and provides an electrical connection to the lighting fixture mounted thereon. The portion of the wire connecting to the electrical source is projected through a hole drilled into the groove in the slat board and then connected to a receptacle bank located behind the display.

BRIEF SUMMARY OF THE INVENTION

The present invention relates to a display for lighting fixtures or the like and incorporates a slat board type panel of the type having a series of lateral or horizontal grooves. A series of mounting plates are provided to support individual lighting fixtures. Each mounting plate has an electrical wire attached thereto. At one end of the wire is a standard plug which can mate with a power receptacle. The opposite end of the wire is used for attachment to the lighting fixture which is to be secured to the mounting plate. The plates are movable within the grooves of the slat board, and thus the arrangement of the lighting fixtures on the display can be easily varied.

The contemplated display structure includes at least one retainer on the side of the slat board. The retainer mates with the grooves in the slat board and may form a support for the board. The retainer preferably comprises a channel, one portion of which may form the sidewall for the display. Alternatively, a retainer may be formed to mount two adjacent slat board panels. In the preferred embodiment, a series of front and rear tabs are provided along the inside edge of the retainer. The tabs are positioned at different levels and provide a groove for insertion of the edge of the slat board. Adjacent the tabs are retainer openings which align with the grooves in the slat board. The alignment of the openings and grooves permits the electrical wire from the mounting plate to enter the channel of the retainer and be plugged into a receptacle which is mounted at the base of the channel.

The retainer may be provided with a support that extends across the channel to maintain the width of the channel. A cover is provided over the channel to create a pleasing appearance and hide the electrical connections within the retainer. The cover may also include a projecting tab that extends into the groove on the slat board. The tab is used to position the wire from the mounting plate in either the upper or lower portion of the groove. In this manner, the wires are hidden from sight and the electrical connections are made without the need for drilling holes through the slat board.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
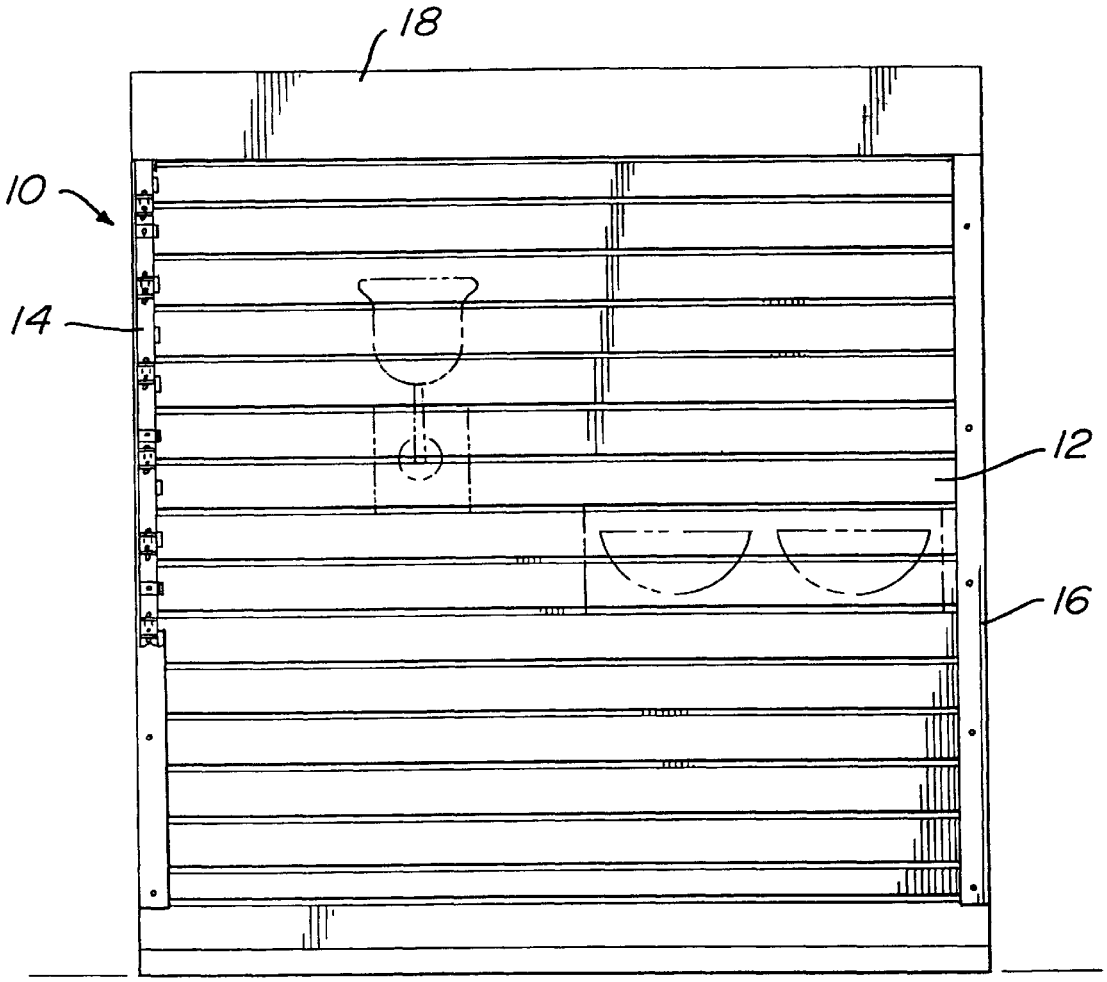
FIG. 1 is a front elevation of a lighting fixture display showing various features of the present invention.

In the drawings, where like numerals identify like elements, there is shown a lighting fixture display that is generally identified by the numeral 10. In FIG. 1, the display 10 is shown as having a mounting board 12, two side retainers 14, 16 and a canopy 18. The mounting board 12 of the display 10 is contemplated to be of a "slat board" type construction. Slat board is a common display material that includes a series of lateral or generally horizontal "T" shaped or similar shaped grooves in the face of the board. The canopy 18 is positioned at the top of the display 10 and projects outwardly from the front of the mounting board 12. The projection of the canopy 18 is more particularly shown in FIG. 3. Slat board material may also be provided on the lower surface of the canopy 18. The retainers 14, 16 are positioned on opposite sides of the mounting board 12 and are formed to support the board 12. The retainers 14, 16 retain electrical outlets or receptacles therein for use with the lighting fixtures to be mounted on the display 10.

Figure 2:
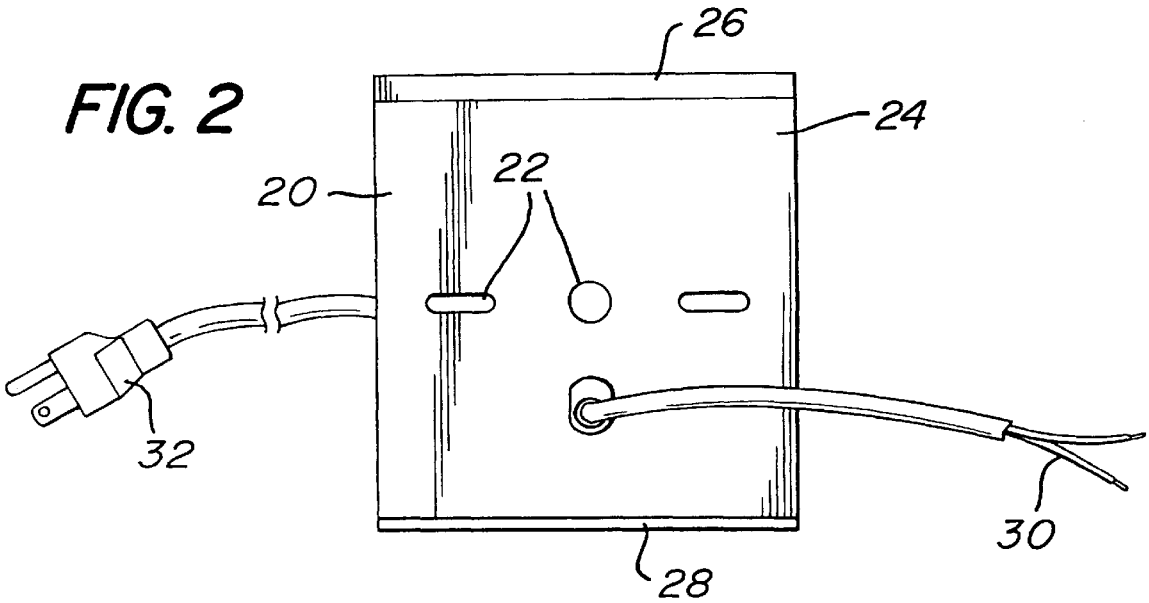
FIG. 2 is a front elevation of a fixture mounting plate portion of the display of the present invention.

In FIG. 2, there is shown a lighting fixture mounting plate 20. The mounting plate 20 generally includes a series of openings 22 on the front surface 24. The openings 22 are provided to receive screws or other mounting structures from a lighting fixture to be mounted thereon. A top tab 26 and a bottom tab 28 are provided on the plate 20. These tabs are used to mount the plate 20 in the grooves of the slat board 12. An electrical wire 30 is attached to the plate 20. At one end of the wire 30 is a standard plug 32 which can mate with a standard electrical receptacle. The opposite end of the wire 30 projects from the front surface 24 of the mounting plate 20 and is used for electrical connection to the light fixture to be mounted thereon.

Figure 3:
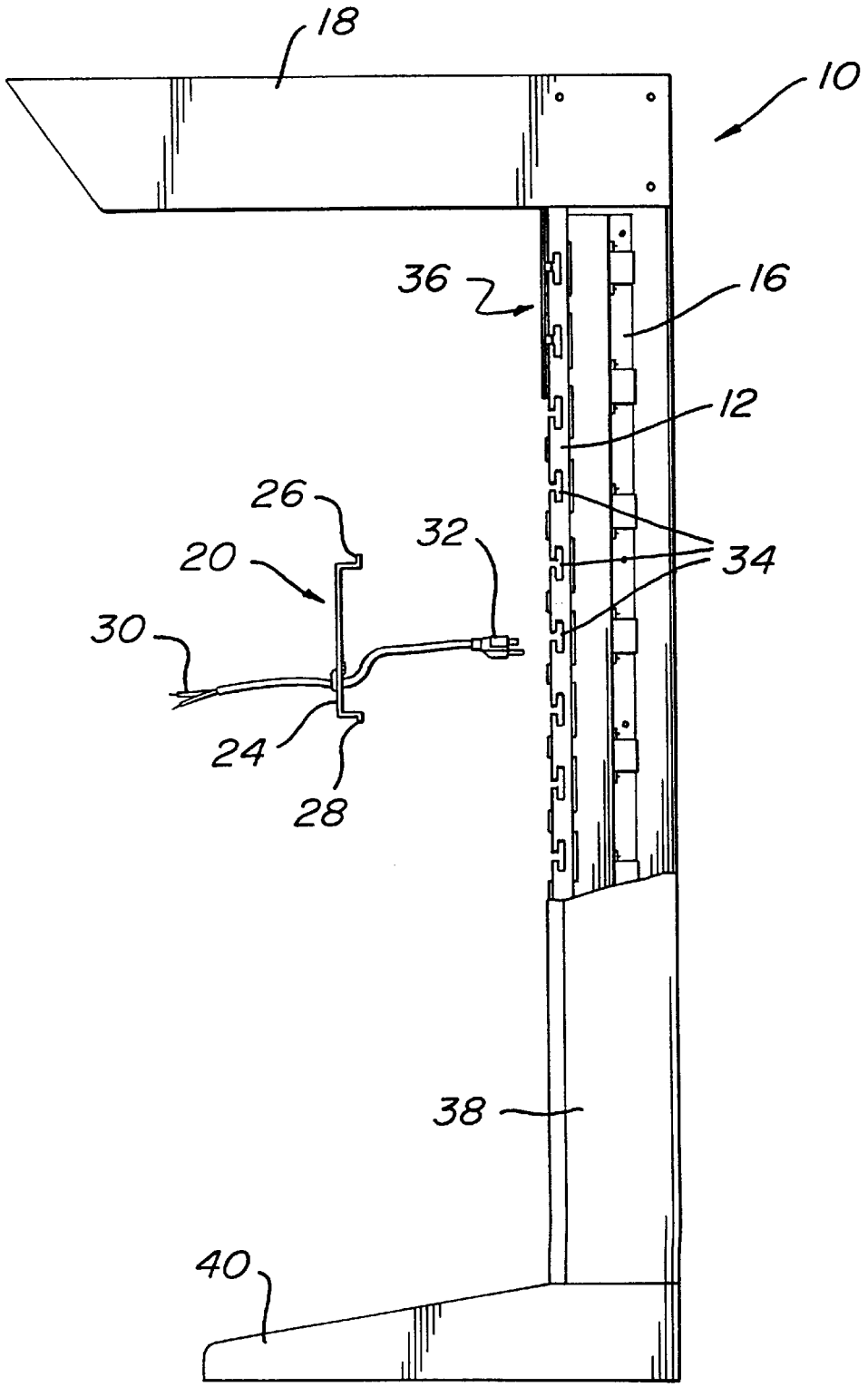
FIG. 3 is a side elevation with a partial cross section showing the display and the mounting plate.

FIG. 3 shows a partial cross sectional view of the mounting board 12 and the display 10. The canopy 18 is positioned above the face 36 of the slat board 12. A series of "T" shaped slat openings or grooves 34 are provided in the face 36 of the board 12. A retainer 16 is positioned at (as seen in FIG. 1) the end of the board 12 and forms a part of the frame 38 for the display 10. The front face 24 of the mounting plate 20 faces outwardly and the two tabs 26, 28 project towards the board 12. The tabs 26, 28 are to be placed in the grooves 34 of the slat board 12. A foot 40 may be provided at the base of the display 10 for support purposes.

Figure 4:
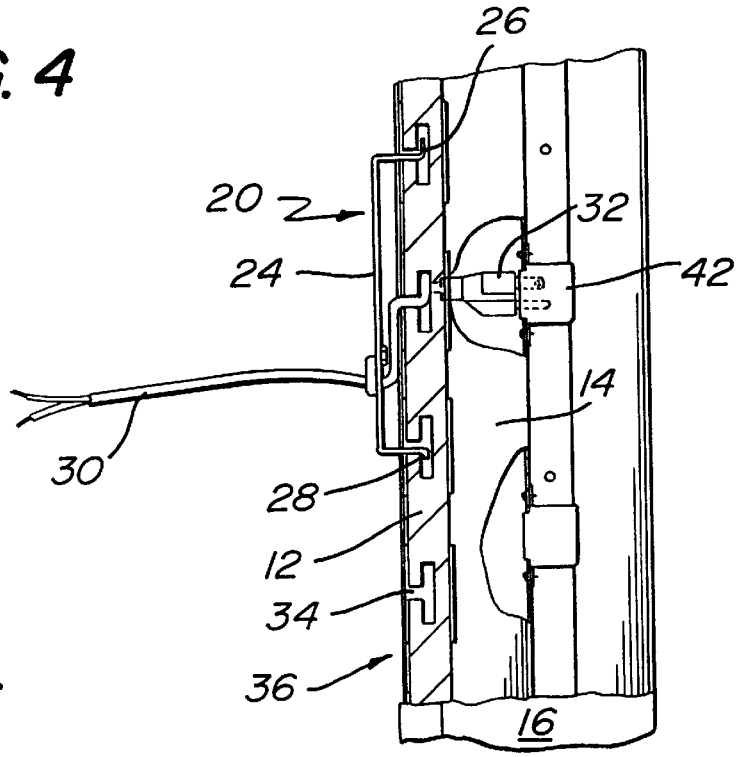
FIG. 4 is a partial cross sectional view showing the relationship between the display and the mounting plate.

In FIG. 4, the mounting plate 20 is shown within its display position on the slat board 12, mounted on the front face 36 of the board 12. The tabs 26, 28 on the top and bottom of the mounting plate 20 are positioned within the "T" shaped grooves 34 in the slat board 12. The upper and lower projection of the tabs 26, 28 secures the plate 20 on the slat board 12 with the plate face 24 positioned generally parallel to the face 36 of the board 12. The rear portion of the electrical wire 30 is positioned within the lower portion of the groove 34 and extends to the (far) end of the board 12. The plug 32 on the end of the wire 30 is connected to an electrical receptacle 42 mounted within the retainer 14 at this (far) end.

Figure 5:
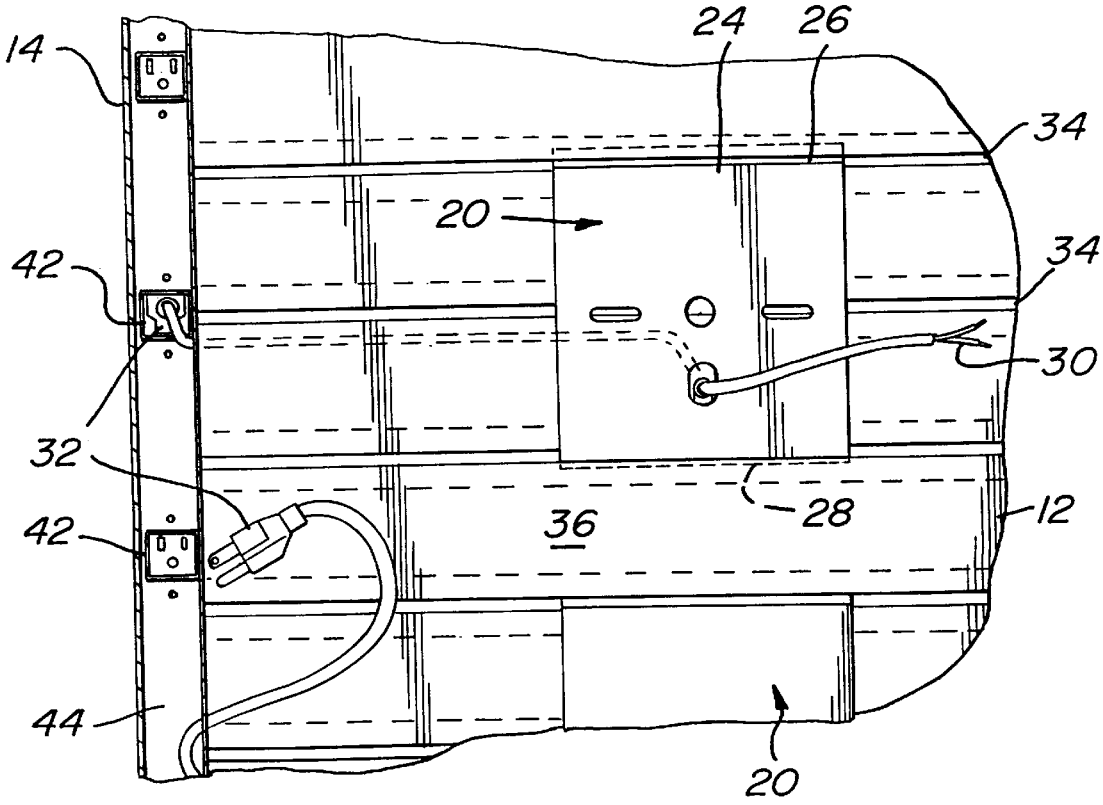
FIG. 5 is a partial front elevation showing the relationship between the display and the mounting plate.

FIG. 5 shows a front view of the mounting plate 20 positioned on the slat board 12. The upper and lower extremities of the "T" shaped grooves 34 are shown in phantom, as are the top and bottom tabs 26, 28 on the mounting plate 20 which are positioned within the grooves 34. The relative position of the receptacles 42 is also shown. The side retainer 14 is positioned adjacent to the edge of the slat board 12. The mounting plate 20 may be fed from one end of the slat board to its position on the board or may be jockeyed into position depending on the relative dimensions of the tabs 26, 28 and the grooves 34. The rear portion of the wire 30 is placed within the groove 34 and extends to the end of the board 12. If multiple plates are mounted adjacent one another, the wire 30 may extend along the top of the groove 34. The retainer 14 is positioned along-side of the slat board 12 and supports the electrical receptacles 42. The plug 32 may be inserted into the receptacle 42 to supply electrical power to the wire and the lighting fixture (not shown) mounted thereon.

Figure 6:
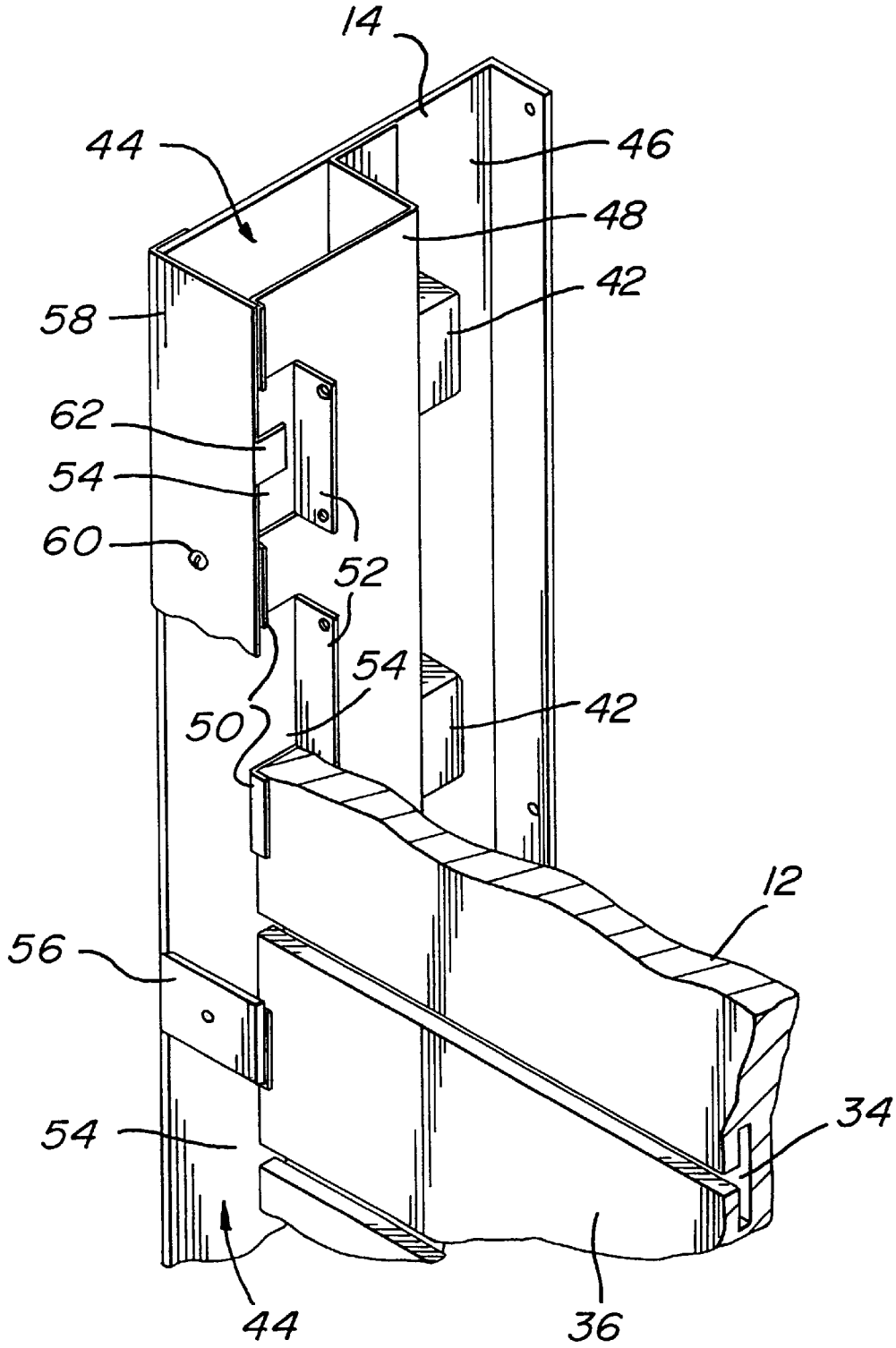
FIG. 6 is a partial perspective view showing the relationship between the slat board of the display and the side retainer for the slat board.

FIG. 6 shows a particular structure for the side retainer 14, it being understood that the retainer 16 on the opposite side of the display 10 is preferably a mirror image of retainer 14 as illustrated. The retainer 14 generally comprises two portions which form a "U" shaped channel 44. At the bottom of the channel 44 are mounted a number of electrical receptacles 42, with the female openings (not shown) facing the inside of the channel. Each receptacle is supplied with electrical power in any desired manner. The outside wall 46 of the retainer 14 forms at least a portion of the side wall of the display 10 and preferably forms a structural frame member. The inside wall 48 of the retainer 14 secures the slat board 12 to the retainer 14. A series of front retainer flanges 50 and rear retainer flanges 52 are provided along the inside portion 48 of the retainer 14. These flanges 50, 52 alternate at different levels and provide a groove for insertion of the edge of the slat board 12. Adjacent the rear flanges 52 is a retainer opening 54 which aligns with the groove 34 in the slat board 12. This alignment permits the electrical wire 30 from the mounting plate 20 (see FIG. 5) to enter the channel 44 of the retainer 14 and the plug 32 (again FIG. 5) to be inserted into a receptacle 42 at the base of the channel 44.

As also shown in FIG. 6, the retainer 14 is provided with an overlay support 56 that extends across the channel 44 so as to maintain the width of the channel and strengthen the retainer 14. A cover 58 is provided over the channel 44 of the retainer 14 so as to create a pleasing appearance and hide the electrical connections within the channel 44. The cover 58 is secured to the retainer 14 by screws 60 or the like at the position of the overlay supports 56. The cover 58 also includes a cover tab 62 that projects perpendicular to the face of the cover and that extends into the retainer opening 54. The cover tab 62 may be used to position the wire 30 from the mounting plate 20 (see FIG. 5) in either the upper or lower portion of the groove 34 in the slat board 12, thus maintaining the wire in the groove and hiding it from view to create a pleasing appearance.

As illustrated, the retainer 14 may be formed by two separately folded elements which are secured together to form the U shaped channel. Alternatively, the retainer structure may be extruded with various portions thereof being knocked out during final configuration. The formation of the alternating flanges and the retainer opening permit the retainer to support the slat board structurally in addition to providing access for the electrical connection between the fixture on the mounting plate and the receptacles within the channel of the retainer. Any convenient manufacturing method may be utilized to accomplished this result.

Figure 7:
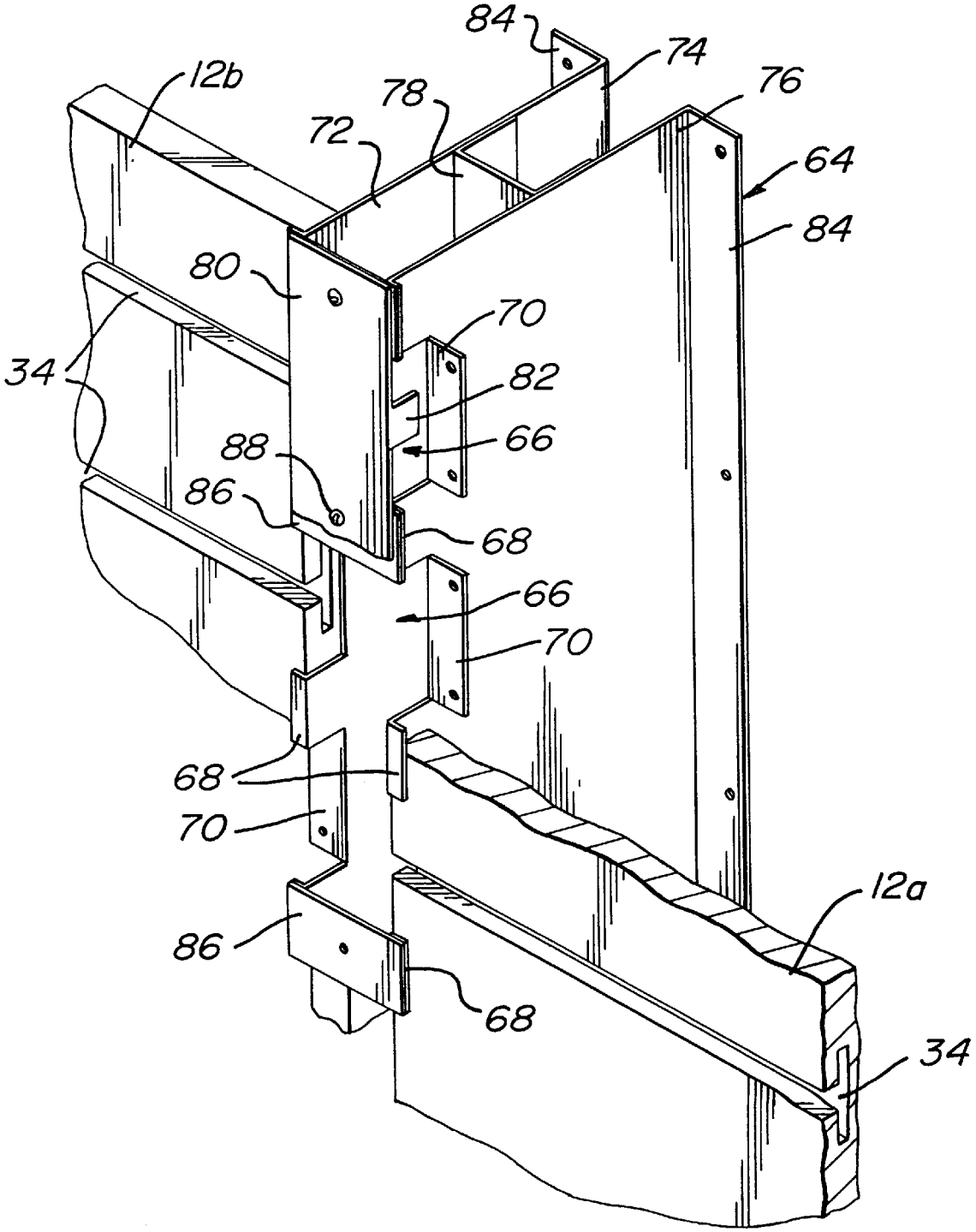
FIG. 7 is a partial perspective view showing an alternate embodiment of the retainer portion of the display.

FIG. 7 shows an alternate embodiment of the retainer for supporting the side edges of the slat board. In this embodiment, the retainer 64 is adapted to retain slat boards 12*a* and 12*b* on both sides. Retainer openings 66 are provided on both sides of the retainer 64, along with alternating flanges 68, 70 to retain the two slat boards 12*a*, 12*b*. The channel 72 formed by the two side walls 74, 76 of the retainer 64 forms a portion of the support frame for the display and defines the space for connecting to the receptacles (not shown). The receptacles are mounted on the rear wall 78 of the channel 72 which extends between the side walls 74, 76. A cover 80 is provided similar to cover 58 in FIG. 6. Cover tabs 82 project into the retainer openings 66 on both sides of the cover 80. Support flanges 84 are provided at the rear of the side walls 74, 76 of the retainer for attaching the display to a support wall (not shown) or for attaching a rear wall (also not shown) to enclose the entire structure. Overlay supports 86 are also provided between the opposing front flanges 68 on the side walls 74, 76 of the retainer. The cover 80 is secured to the overlay supports 86 by screws 88.

The present invention may be embodied in other specific forms without departing from the spirit or essential attributes thereof and, accordingly, reference should be made to the appended claims, rather than to the foregoing specification, as indicating the scope of the invention.

I claim:

1. A display for a plurality of electrical fixtures, the display comprising:

a mounting panel, the panel having a plurality of elongated generally horizontal grooves in a front surface thereof;

a plurality of mounting plates, the mounting plates having flanges adapted to be retained within the panel grooves for movably supporting the mounting plates on the front surface of the panel;

an electrical connection supported on the mounting plates;

a retainer engaging a side edge of the mounting panel;

a plurality of electrical receptacles mounted within the retainer for supplying electrical power; and the retainer having a sidewall that separates the electrical receptacles from the mounting panel, the sidewall having openings therein for access for the mounting plate electrical connection to the receptacles within the retainer.

2. A display as claimed in claim 1 further comprising a second retainer engaging an opposite edge of the mounting panel, the second second retainer including a second plurality of electrical receptacles mounted in the retainer for supplying electrical power; and the retainer having openings therein for providing access for the mounting plate electrical connection to the receptacles within the second retainer.

3. A display as claimed in claim 1 wherein the retainer openings are aligned and communicate with the plurality of elongated generally horizontal grooves within the front surface of the mounting panel.

4. A display as claimed in claim 1 wherein the retainer provides a support for the mounting panel, the retainer having means for engaging the side edge of the panel.

5. A display as claimed in claim 1 wherein the retainer defines a U shaped channel including a base and two opposed walls, the electrical receptacles mounted within the base of the U shaped channel.

6. A display as claimed in claim 5 further comprising a retainer cover removably secured to the front of the retainer adjacent the front surface of the mounting panel and covering the U shaped channel, the cover hiding the electrical receptacles from view when attached to the retainer.

7. A display as claimed in claim 1 further comprising a second mounting panel having a plurality of elongated generally horizontal grooves in the front surface thereof, the retainer engaging a side edge of the second mounting panel, positioning the mounting panel and second mounting panel adjacent one another with the retainer therebetween, the retainer having an opening therein for providing access for electrical connections supported on mounting plates to be movably mounted on the second mounting panel.

8. A display for supporting a plurality of electrical fixtures, the display comprising:

a mounting panel, the panel having a plurality of elongated generally horizontal grooves formed in a front surface thereof;

a plurality of mounting plates, the mounting plates having flanges adapted to slidably engage with and be retained by the panel grooves for movably supporting the mounting plates on the front surface of the panel, the mounting plates each having at least one aperture formed therein for mounting a light fixture thereto;

an electrical connection extending out from each mounting plate and having a plug end;

frame members mounted to side edges of the mounting panel, at least one frame member having a channel formed therein including a base and two opposed walls extending forwardly from the base and defining an open end of the channel, and a cover removably attached to the at least one frame member over the open end of the channel, removal of the cover allowing access to the channel; and a plurality of electrical receptacles for supplying electrical power, each electrical receptacle mounted to the channel so as to locate the plug end of the electrical connection within the channel when the plug end is engaged with an electrical receptacle, the cover hiding the electrical receptacles from view when attached to the at least one frame member.

9. A display as claimed in claim 8 wherein each frame member includes a channel with a removable cover, each channel having a plurality of electrical receptacles mounted therein.

10. A display as claimed in claim 8 wherein the channel includes a base and two opposed walls extending forwardly from the base and defining an open end of the channel, at least one of the walls including a plurality of openings, the openings adapted to permit an electrical connection to pass from the panel groove into the channel.

11. A display as claimed in claim 8 further comprising a second mounting panel having a plurality of elongated generally horizontal grooves in a front surface thereof, at least one frame member engaging a side edge of the second mounting panel, the mounting panel and the second mounting panel positioned adjacent one another with the frame member therebetween, and wherein the channel includes a base with two opposed walls extending forwardly from the base and defining an open end of the channel, at least one of the walls has a series of openings which communicate with the plurality of elongated generally horizontal grooves formed in the second mounting panel.

12. A display as claimed in claim 8 wherein the elongated generally horizontal grooves are T-shaped.

13. A display for supporting a plurality of electrical fixtures, the display comprising:

a mounting panel, the panel having a plurality of elongated generally horizontal grooves formed in a front surface thereof;

a plurality of mounting plates, the mounting plates having flanges adapted to slidably engage with and be retained by the panel grooves for movably supporting the mounting plates on the front surface of the panel, the mounting plates each having at least one aperture formed therein for mounting a light fixture thereto;

an electrical connection extending out from each mounting plate and having a plug end;

frame members mounted to side edges of the mounting panel, at least one frame member having a channel formed therein including a base and two opposed walls extending forwardly from the base and defining an open end of the channel, and a cover removably attached to the at least one frame member over the open end of the channel, removal of the cover allowing access to the channel, wherein the frame members support the mounting panel and include a vertical groove along one edge for engaging a side edge of the mounting panel; and a plurality of electrical receptacles for supplying electrical power, each electrical receptacle mounted to the channel so as to locate the plug end of the electrical connection within the channel when the plug end is engaged with an electrical receptacle.

14. A display as claimed in claim 13 wherein the vertical groove includes a series of offset flanges formed in the channel.

15. A display for a plurality of electrical fixtures, the display comprising:

a mounting panel having a plurality of elongated generally horizontal grooves formed in a front surface thereof;

a plurality of mounting plates, the mounting plates having flanges adapted to slidably engage with and be retained by the horizontal grooves for movably supporting the mounting plates on the front surface of the panel, the mounting plates each having at least one aperture formed therein for mounting a light fixture thereto;

an electrical connection extending out from each mounting plate, the electrical connection having a cord and a plug end;

frame members mounted on side edges of the mounting panel, each of the frame members including a cover attached thereto, an outlet wall located within the frame member and spaced apart from the cover, the cover being removable to permit access to the outlet wall, and an inner side wall disposed between the outlet wall and the mounting panel, the inner sidewall having flanges which extend toward and engage with the mounting panel, the inner side wall including a plurality of openings adapted to permit the electrical connection to pass into the channel, the openings in the inner side wall communicating with the plurality of elongated generally horizontal grooves formed in the mounting panel; and a plurality of electrical receptacles attached to the outlet wall for supplying electrical power;

the cord of each electrical connection adapted to lie within a groove and pass through an opening in the inner side wall, and the plug end adapted to be located between the outlet wall and the removable cover when the plug end is engaged with an electrical receptacle.

* * * * *